United States Patent [19]

Warrick

[11] 4,019,312

[45] Apr. 26, 1977

[54] METHOD OF COMBINING SYNTHETIC YARNS

[75] Inventor: Ford E. Warrick, Asheville, N.C.

[73] Assignee: Akzona Incorporated, Asheville, N.C.

[22] Filed: May 16, 1975

[21] Appl. No.: 578,065

[52] U.S. Cl. ..... 57/157 S; 28/72.17; 57/140 BY; 57/157 F

[51] Int. Cl.[2] ..... D02G 3/04; D02G 1/18

[58] Field of Search ..... 57/140 BY, 157 S, 157 F; 28/71.3, 72.17

[56] References Cited

UNITED STATES PATENTS

| | | | |
|---|---|---|---|
| 1,976,201 | 10/1934 | Taylor | 57/157 S |
| 2,004,139 | 6/1935 | Taylor | 57/157 S |
| 3,061,998 | 11/1962 | Bloch | 57/140 BY |
| 3,199,281 | 8/1965 | Maerov et al. | 57/157 S |
| 3,724,199 | 4/1973 | Armstrong et al. | 57/157 S |

*Primary Examiner*—Richard C. Queisser
*Assistant Examiner*—Charles Gorenstein
*Attorney, Agent, or Firm*—Jack H. Hall; Francis W. Young

[57] ABSTRACT

A method is provided for combining continuous filament synthetic yarns of different shrinkage characteristics where one yarn is drawn and a second, previously drawn yarn is combined therewith without drawing the second yarn.

6 Claims, 3 Drawing Figures

METHOD OF COMBINING SYNTHETIC YARNS

BACKGROUND OF THE INVENTION

This invention relates to a new method of combining continuous filament synthetic yarns of different shrinkage characteristics, particularly a method of combining polyester yarn with drawn polyamide yarn during the polyester yarn drawing process.

In the usual polyester drawtwisting process, undrawn yarn is led from a package placed on a creel to feed rolls which are driven at a constant speed, then across heated metal pins, and then to a take-up godet driven at typically several times the speed of the feed rolls. By this means, the yarn is drawn or extended several times in length for the purpose of moleculary orientating the yarn and developing desired final propertis of strength and elongation. From the take-up godet, the yarn may optionally pass through a tangling device and then through a traveler, which rotates around a ring, and onto a pirn which is mounted on a rotating spindle.

In marketing synthetic yarns, there is always a demand for new combinations of yarn which can be processed in a variety of ways. A combination of polyester and polyamide continuous filament yarns would be useful for a number of reasons, one in particular being that by dyeing a knitted or woven fabric made of the combined yarns with suitable dyes, the polyester and polyamide components would be dyed differently, and a "heather" effect from the differential dyeing is obtained. The dyeing characteristics of polyester and polyamide are sufficiently different so that dyeing the combined yarns with the same dye bath can give contrasting colors or a white-and-color effect. Dyeing a combination of two different types of polyester or two different types of polyamide gives only a tone-on-tone effect. From the point of view of a synthetic yarn producer, it would be very desirable to market a combined polyester and polyamide drawn yarn on pirns, ready for texturing, or suitable for knitting or weaving as the next manufacturing step before dyeing.

A prior method of combining polyester and polyamide yarns would be to use a pirn of drawn yarn of each type to supply an end of each yarn to a drawtwister, bypassing the feed roll so no further drawing would take place, winding the yarns around the draw godet, then running the two ends through a tangling or other interlacing device, and finally winding the combined ends on a pirn through use of the ring traveler and lay-rail mechanism in the usual manner.

However, it has been found to be very difficult or impossible to wind combined ends of polyester and polyamide on a pirn in this manner without formation of "loops" in the yarn which makes the quality unacceptable. On unwinding a length of the combined yarn from the pirn, it is found that the polyamide yarn has contracted more than the polyester yarn, causing the yarns to separate. The excess length of the polyester compared to the polyamide causes the loops to form.

Another prior method of combining polyester and polyamide yarn is to place undrawn packages of ech yarn on a doublecreeled drawtwister, combine the ends of yarn, and go through the usual complete drawing process with the combined ends. It has been found that this resulted in the same difficulties as was found with combining two previously drawn ends, as the yarn obtained is still loopy and poorly combined.

The apparent reason for the difficulty in combining different types of yarns such as polyester and polyamide by direct methods is the different shrinkage or contraction which the yarns exhibit after being subjected to tension. In winding from two drawn pirns or drawing from two undrawn packages, the combined yarns are subjected to the same forces by the action of the package-building mechanism such as the traveler and rotating spindle on a drawtwister. After winding on a pirn or other collecting package and then being unwound, the yarn with a greater tendency to shrink, polyamide in the case of a polyester-polyamide combination, will contract enough to cause the combined yarns to separate and form loops.

Attempts have been made to alter the physical properties of the undrawn polyester and polyamide yarns by winding them at different speeds, and by modifying the feed rolls of the drawtwister, in order to have the final physical properties, for example, the orientation and shrinkage of the yarn, match closely enough so that good quality combined yarn is obtained. These attempts have not been successful compared to the results obtained by the method of this invention.

It has been found that with the use of this invention, polyester and polyamide yarns may be combined on a drawtwister to obtain a product of acceptable uniform quality and free of loops.

SUMMARY OF THE INVENTION

This invention comprises a method of combining continuous filament synthetic yarns on a drawtwister by drawing an undrawn yarn while introducing thereto another previously drawn yarn of higher shrinkage characteristics in such a manner that the introduced yarn is not subject to further drawing. The yarns are combined and passed together around the draw godet. A tangling device may be used to attach the yarns more firmly together, and the combined ends are wound together on a pirn or other collecting device.

DESCRIPTION OF THE PREFERRED EMBODIMENTS

Figure 1:
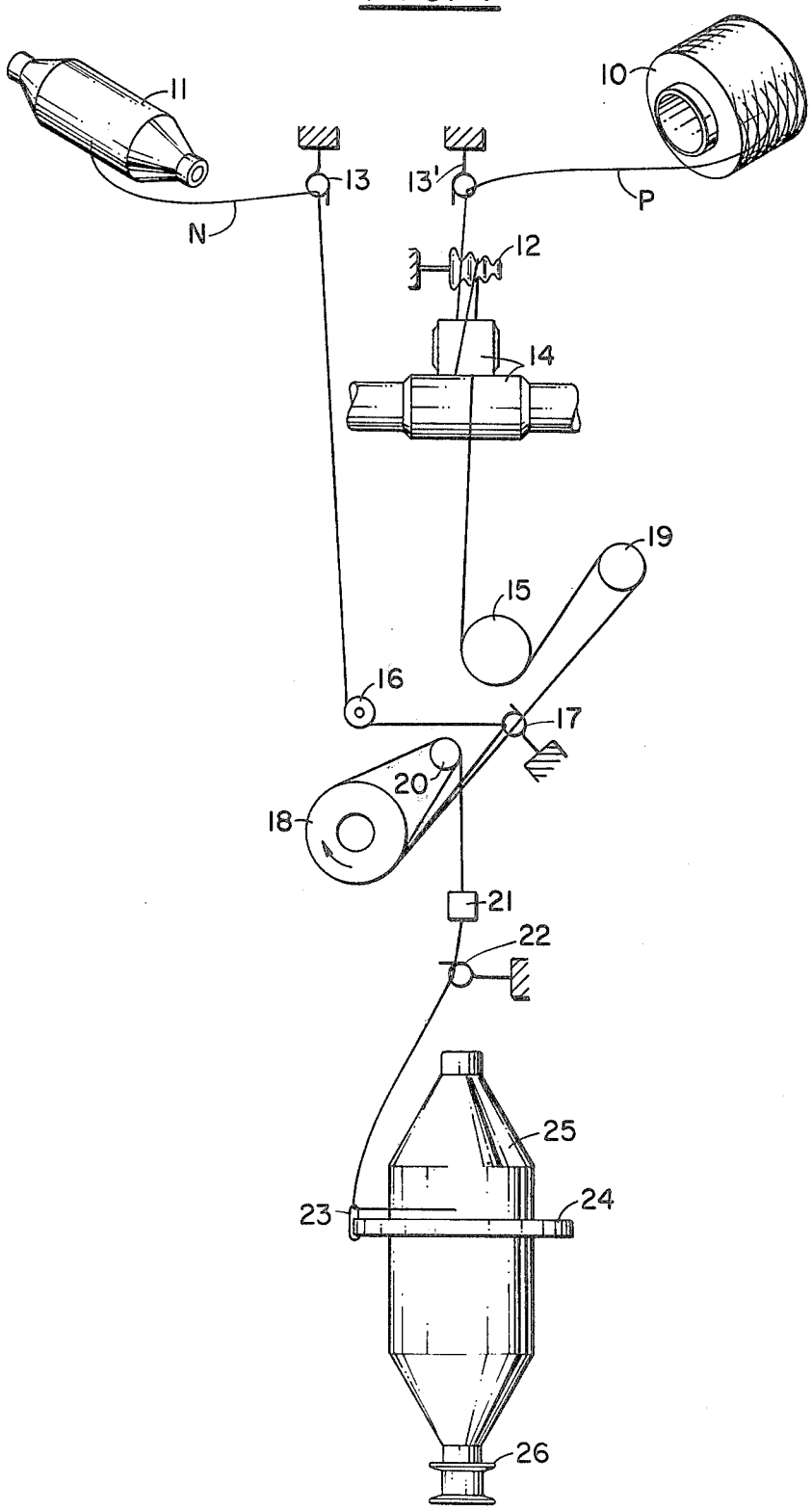
FIG. 1 is an elevational view of a drawtwister on which the present invention may be practiced.

In FIG. 1, a representative arrangement is shown for combining polyester and polyamide yarns on a drawtwister. The practice of the present invention is thus illustrated, but this illustration of the method is not intended to be limiting. For instance, other arrangements of draw rolls and draw godets or placement of yarn guides may be used.

Undrawn polyester yarn P travels from a package 10 through a guide 13' and feed rolls 14 with associated barrel guide 12 across hot pins 15 and 19 to guide 17. The polyester yarn P is drawn between the feed rolls 14 and draw godet 18. Drawn polyamide yarn N is led from a pirn 11 through guide 13, bypassing the feed rolls 14 to guide 16 and then to guide 17. At guide 17, the yarns P and N are combined, led several times around the draw godet 18 and separator roll 20, then through a tangling device 21, if utilized, and through a guide 22, from which the combined yarns are wound on pirn 25 through the action of the traveler 23 on the ring 24 in the usual manner.

One method of starting the combining of the polyester and polyamide yarns is to pass the ends of yarns P and N through the respective guides 13' and 13, twist the ends together and thread them through the tangling device 21, the guide 22, and through the traveler 23. The combined yarn may then be wound on waste whorl 26 in the usual manner of drawing a single end of yarn. The end P is then passed around the feed roll 14 and around the hot pins 15 and 19. The end N is passed through guides 16 and 17, and the ends P and N are wrapped around the draw godet 18 and the separator roller 20, and winding is started on the pirn in the normal manner.

In practice, it has been found that it may be difficult to complete the operation of starting the drawing of the combined yarns after placing the combined ends on the waste whorl 26, as the yarn tends to break while the remaining thread-in operation is completed. One method of overcoming this difficulty is to temporarily increase the tension in the end P by looping it around the guide 12. After completion of threading-in, the end P may be looped around the guide 12 and feed roll 14 in the usual manner.

Figure 2A:
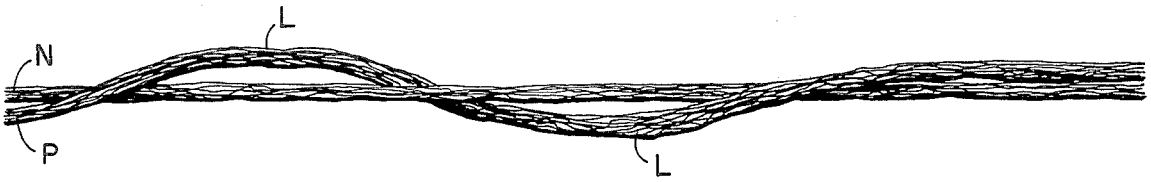
FIG. 2a PRIOR ART
FIG. 2A is a representation of polyester and polyamide yarns combined according to previously known methods and showing typical loops as previously described.

FIG. 2A illustrates the results obtained when two pirns of previously drawn polyester and polyamide are combined together on a pirn. On unwinding the yarn from the pirn, it is found that the polyamide yarn N has shrunk compared to the polyester yarn P and the excess polyester yarn causes loops L to form.

Figure 2B:
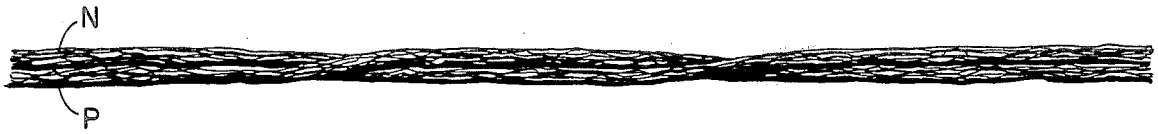
FIG. 2B is a representation of polyester and polyamide yarns combined in accordance with the present invention.

FIG. 2B represents the results obtained after combining polyester and polyamide yarn using the method of this invention. On unwinding the combined yarns from a pirn, the yarns P and N are combined together into what appears a single, integrated yarn, substantially free from loops.

After the process of this invention was developed, additional experiments were carried out to determine if the combining of yarns could be carried out in the opposite manner, that is, by drawing the polyamide yarn while introducing fully drawn polyester yarn thereto. It was found that the yarn combined under these conditions was as "loopy," if not more so, than yarn obtained by drawing both ends together or by combining previously drawn yarns.

It was concluded that the success of the method of this invention depends on inherent differences in the shrinkage of polyester and polyamide yarn when subjected to the methods of drawing described, and that the forces developed in the action of drawing the polyester yarn can be made to counteract almost exactly the tendency of the polyamide yarn to shrink, compared to polyester yarn, in the combining process.

By use of this invention, any two yarns which can be drawn and which have different shrinkage characteristics after being drawn, can be combined. In general, the yarn with the lesser shrinkage tendency is drawn, and the yarn with the greater shrinkage tendency is previously drawn, introduced, and combined without being subjected to further drawing. The yarn which is drawn during the combining has an additional tendency to shrink, and this compensates and tends to equalize the shrinkage of the two components of the combination.

A number of different samples of combined yarns, wound on pirns, have been made by the process of this invention, and the following examples are representative but not intended to be limiting. Yarns referred to in these illustrative examples were melt spun by conventional methods and drawn on standard equipment details of which are not included since they are well-known.

EXAMPLE I

Polyethylene terephthalate yarn of 14 filaments with a nominal denier of 70 after drawing, was collected undrawn on a tube. Polyamide yarn of 40 denier, 13 filaments was wound on a pirn fully drawn by the usual method as practiced in the art. The two yarns were then combined by the process of this invention.

The pirn containing combined polyester and polyamide yarns was inspected for "loopiness" in the usual manner by looking closely along the edge of the pirn. The pirn of combined yarn was not more loopy than normal pirns of undrawn polyester singles yarn or polyamide singles yarn. On unwinding several yards of the combined yarn, it was found that the polyester and polyamide ends were well combined together and appeared as one yarn with no loops.

EXAMPLE II.

Polyethylene terephthalate yarn of 24 filaments with a nominal denier of 120 after drawing was collected undrawn on a tube. Polyamide yarn of 30 denier, 20 filaments was wound on a pirn fully drawn by the usual method as practiced in the art. The two yarns were then combined by the process of this invention.

The pirn containing combined polyester and polyamide was inspected as in Example I. The yarn was not loopy and was well combined and appeared as one yarn.

EXAMPLE III

Polyethylene terephthalate yarn of 13 filaments with a nominal denier of 40 after drawing was collected undrawn on a tube. Polyamide yarn of 20 denier, 5 filaments was wound on a pirn fully drawn by the usual method as practiced in the art.

The pirn containing combined polyester and nylon was inspected as in Example I. The yarn was not loopy and was well combined together and appeared as one yarn.

What is claimed is:

1. A method of combining continuous filament yarns of different shrinkage characteristics comprising: drawing a first synthetic yarn to produce elongation therein while combining therewith a second previously drawn synthetic yarn having a relatively higher shrinkage characteristic without imparting elongation to the second yarn.

2. The method as set forth in claim 1 wherein said first yarn is polyester.

3. The method as set forth in claim 2 wherein said second yarn is polyamide.

4. The method of claim 1 comprising passing said combined yarns through a tangling device before winding said yarns on a yarn collecting device.

5. A method of combining undrawn polyester and drawn polyamide continuous filament yarns on a drawtwister having two creels provided for each drawing position and having means including a feed roll and a draw godet for drawing yarn, comprising having undrawn continuous filament polyester yarn on one creel position, and having drawn continuous filament polyamide yarn on a second creel position, comprising the steps of drawing said polyester yarn by use of said feed roll and said draw godet, and simultaneously introducing said polyamide yarn between said feed roll and said draw godet so the said drawn polyamide yarn is not further drawn; combining the said polyester and said polyamide yarns, and leading said combined yarns around the second draw godet; and winding said combined yarns on a yarn collecting device.

6. Method of claim 5 comprising passing the said combined yarns through a tangling device before winding said yarns on a yarn collecting device.

* * * * *